United States Patent [19]

Gardner

[11] 3,963,169

[45] June 15, 1976

[54] PARTITION ARRANGEMENT

[75] Inventor: Jeffrey M. Gardner, Wheaton, Ill.

[73] Assignee: Container Corporation of America, Chicago, Ill.

[22] Filed: Aug. 1, 1975

[21] Appl. No.: 601,025

[52] U.S. Cl. ..... 229/28 R; 229/15

[51] Int. Cl.[2] ..... B65D 5/48

[58] Field of Search ..... 229/15, 27, 28 R

[56] References Cited

UNITED STATES PATENTS 3,327,919 6/1967 Kim ..... 229/15

3,702,170 11/1972 Adams ..... 229/15

*Primary Examiner*—William Price

*Assistant Examiner*—Douglas B. Farrow

[57] ABSTRACT

A partition arrangement formed of a unitary blank of foldable paperboard cut and scored to provide a bottom panel, a transverse partition cut from material of the bottom panel and hinged thereto, and a longitudinal partition member hinged to the bottom panel and having interlocking engagement with the transverse partition member.

4 Claims, 4 Drawing Figures

PARTITION ARRANGEMENT

SUMMARY OF THE INVENTION

It is an object of the invention to provide an inner partition formed from paperboard or the like for use in an outer shipping container.

A more specific object of the invention is to provide a partition including a bottom panel, a transverse vertical partition member cut from and hinged to the bottom panel, and a longitudinal vertical partition member hinged to the bottom panel and having interlocking engagement with the transverse partition member.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

Figure 1:
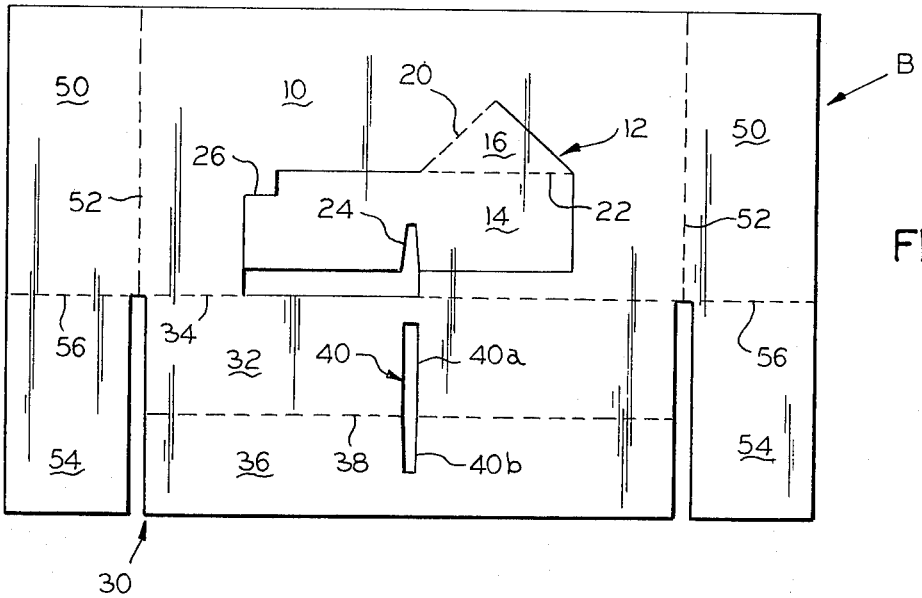
FIG. 1 is a plan view of a blank of sheet material from which the partition illustrated in the other views may be formed.
Figure 4:
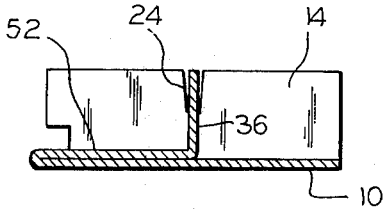
FIG. 4 is a transverse vertical section taken on line 4—4 of FIG. 3.
Figure 3:
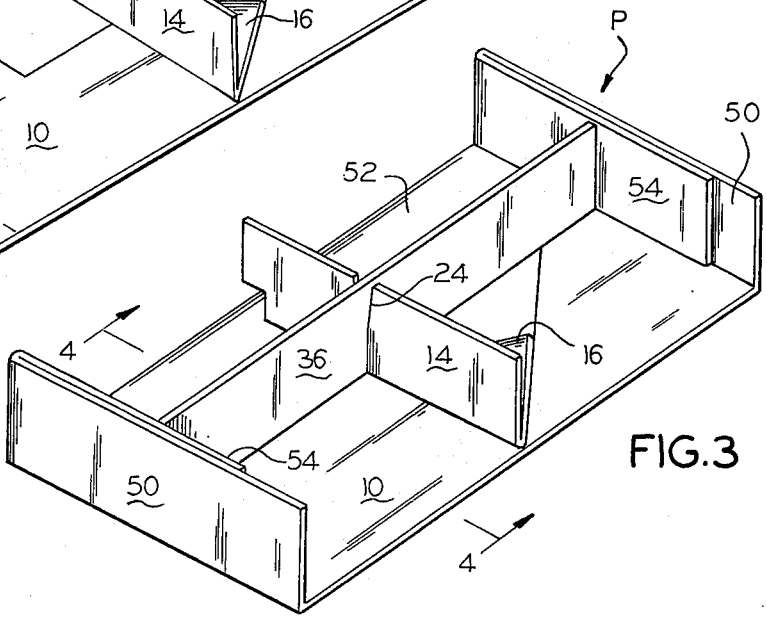
FIG. 3 is a view similar to that of FIG. 2, but showing the partition fully erected.

Referring now to the drawings, it will be seen that the novel one-piece partition indicated generally at P which embodies features of the invention is illustrated in an erected condition in FIG. 3 and may be formed from a unitary blank of foldable paperboard indicated generally at B and illustrated in FIG. 1 of the drawings.

The partition includes a preferably rectangular central or outer bottom wall panel 10 on which are positioned a transverse partition member 12 and a longitudinal partition member 30 in interlocking relationship with each other.

Transverse partition member 12 includes a vertical element 14 and a horizontal gusset element 16 which serves to connect the vertical element to the outer bottom panel. Both the vertical element 14 and the gusset element 16 are formed from material cut from the outer bottom panel 10. Gusset element 16 is preferably generally triangular in shape and is foldably connected at one side edge along fold line 20 to the remaining portion of outer bottom panel 10 and is foldably connected along another side edge on fold line 22 to the lower edge of vertical element 14. It will be noted that fold line 22 extends in a direction parallel to the longitudinal axis and the side edges of outer bottom panel 10 and that fold line 20 extends at an angle less than 90° relative to fold line 22. The longitudinal partition member 30 includes a preferably rectangular inner bottom panel 32 which is foldably connected along one side edge to an adjacent side edge of outer bottom panel 10 along a fold line 34 and is foldably connected along its other side edge to a vertical element 36 along a fold line 38.

Longitudinal member inner bottom panel 32 and vertical element 36 are provided with aligned slots 40a and 40b, respectively, which run together to form a common or continuous slot 40.

Figure 2:
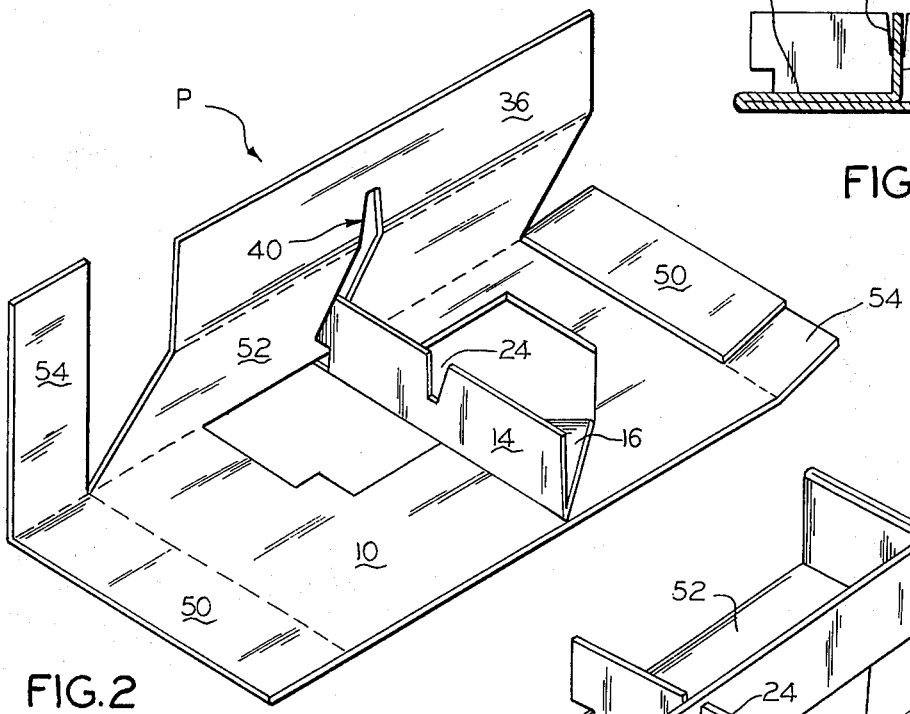
FIG. 2 is a perspective view of a partially erected partition enbodying features of the invention.

In forming or erecting the partition arrangement, the transverse member vertical element and gusset element are folded 180° on fold line 20 and the vertical element 14 is reverse folded 90° so as to extend in a vertical plane, as best seen in FIGS. 2 and 3, which extends transversely of outer bottom panel 10.

Thereafter, the longitudinal partition member inner bottom panel 32 and vertical element 36 are folded inwardly as shown in FIG. 2 with the inner bottom panel being folded 180° so as to come in face-to-face contact with the upper surface of outer bottom panel 10 and with vertical element 36 being reverse folded 90° so as to lie in a vertical plane extending longitudinally of the outer bottom panel 10. The slots 40a and 40b receive the transverse partition member vertical element 14 with the slot 40b in the longitudinal partition member vertical element interlocking with a related slot 24 presented in the upper edge of the transverse partition member vertical element 14. It will be noted that the lower corner of the transverse partition member vertical element 14 is cut away as at 26 to provide clearance so that the inner bottom panel can be folded over onto the outer bottom panel with the transverse vertical element being received within the slot. The inner bottom panel serves to cover most of the opening formed by the removal of the material utilized for the transverse partition member.

If desired, end portions may be provided for the structure, each of which includes end panel outer section 50 foldably connected along a fold line 52 to an end edge of outer bottom panel 10 and an inner section 54 foldably connected at a side edge to an adjacent side edge of outer section 50 and folded inwardly so as to lie in face-to-face engagement with the inner surface of the outer section and in engagement with the end edge of the longitudinal partition member vertical element.

Thus, it will be appreciated that the novel partition arrangement of the present invention is of simple design and construction which utilizes a minimum amount of material, and at the same time provides a strong and rigid structure having interlocking transverse and vertical partition members suitable for use within an outer container and adapted to be stacked with corresponding partition arrangements in a multilayered packaged.

We claim:

1. In a four-cell partition arrangement formed from a unitary blank of foldable paperboard, the combination of:

a. a generally rectangular outer bottom panel;

b. a transverse partition member cut from material of said outer bottom panel and including:

i. a first vertical element;

ii. a generally triangular gusset element foldably connected at one edge to a lower edge of said first vertical element on one fold line extending transversely of said outer bottom panel, foldably connected along another edge to said outer bottom panel along another fold line which diverges from said one fold line at an angle of less than 90°, and being disposed in face-to-face engagement with the upper surface of said outer bottom panel;

c. a longitudinal partition member including:

i. a second vertical element;

ii. an inner bottom panel foldably connected at one side edge to a side edge of said outer bottom panel, foldably connected at another side edge to a lower edge of said second vertical element, and being disposed in face-to-face engagement with the upper surface of said outer bottom panel to cover at least a portion of the opening formed by the removal of the material for said transverse partition member;

iii. said second vertical element and said inner bottom panel having aligned slots for receiving a portion of said first vertical element;

d. said first vertical element having a slot extending downwardly from its upper edge for receiving a portion of said second vertical element to provide interlocking engagement therebetween.

2. In a partition arrangement formed from a unitary blank of foldable paperboard, the combination of:

a. an outer bottom panel;

b. a first partition member cut from material of said outer bottom panel and including;

i. a first vertical element;

ii. a generally triangular gusset element foldably connected at one edge to a lower edge of said first vertical element on one fold line, foldably connected along another edge to said outer bottom panel along another fold line which diverges from said one fold line at an angle of less than 90°, and being disposed in face-to-face engagement with the upper surface of said outer bottom panel;

c. a second partition member disposed at an angle with respect to said first partition member and including:

i. a second vertical element;

ii. an inner bottom panel foldably connected at one side edge to a side edge of said outer bottom panel, foldably connected at another side edge to a lower edge of said second vertical element, and being disposed in face-to-face engagement with the upper surface of said upper bottom panel to cover at least a portion of the opening formed by the removal of the material for said first partition member;

iii. said second vertical element and said inner bottom panel having aligned slots for receiving a portion of said first vertical element;

d. said first vertical element having a slot extending from its upper edge for receiving a portion of said second vertical element to provide interlocking engagement therebetween.

3. A partition arrangement according to claim 2, wherein said first vertical element has a corner portion recessed adjacent the slot in said inner bottom panel to accommodate the passage of said first vertical element through said inner bottom panel slot during erection thereof.

4. A partition arrangement according to claim 2, and including at least one end partition member, comprising:

a. an outer panel foldably connected at its lower edge to an end edge of said outer bottom panel;

b. an inner panel foldably connected at a side edge to a side edge of said outer panel and folded into face-to-face engagement with the inner surface of said outer panel adjacent an end edge of said second vertical element.

* * * * *